US005294042A

United States Patent [19]

Giordano

[11] Patent Number: 5,294,042

[45] Date of Patent: Mar. 15, 1994

[54] EXTERIORLY CONTROLLED ADDRESSING SYSTEM FOR WINDOW MAILERS

[76] Inventor: Dennis R. Giordano, 220 Steven Dr., Cheektowaga, N.Y. 14227

[21] Appl. No.: 980,434

[22] Filed: Nov. 23, 1992

Related U.S. Application Data

[63] Continuation of Ser. No. 840,567, Feb. 24, 1992, abandoned, which is a continuation-in-part of Ser. No. 732,904, Jul. 19, 1991, abandoned.

[51] Int. Cl.[5] ..... B65D 27/04; B31B 1/90

[52] U.S. Cl. ..... 229/71; 229/69; 493/216; 493/919

[58] Field of Search ..... 229/69, 71; 493/216, 493/919

[56] References Cited

U.S. PATENT DOCUMENTS

| | | | |
|---|---|---|---|
| 3,350,988 | 11/1967 | Schultz | 493/919 X |
| 3,412,655 | 11/1968 | Krańz | 493/919 X |
| 4,172,605 | 10/1979 | Welsch et al. | 229/69 X |
| 4,413,984 | 11/1983 | Alter | 493/919 X |
| 4,597,591 | 7/1986 | Gendron et al. | 229/71 X |
| 4,625,909 | 12/1986 | Ferrando | 229/69 X |
| 4,705,298 | 11/1987 | Van Malderghem et al. | 229/69 X |
| 4,729,506 | 3/1988 | Neubauer | 229/71 X |
| 4,741,475 | 5/1988 | Norman | 229/69 X |
| 4,824,142 | 4/1989 | Dossche | 229/69 X |
| 5,024,374 | 6/1991 | Ashby | 229/71 |

FOREIGN PATENT DOCUMENTS

| | | | |
|---|---|---|---|
| 102792 | 3/1984 | European Pat. Off. | 229/71 |

*Primary Examiner*—Allan N. Shoap
*Assistant Examiner*—Jes F. Pascua
*Attorney, Agent, or Firm*—Michael G. Berkman

[57] ABSTRACT

A mailer for use with computer printing techniques. The mailer utilizes die-cut window envelopes provided with a transparent window web an undersurface of which is coated with a chemical composition. A sheet contained in the envelope and visible through the window is coated on its surface presented to the window with a second, different chemical composition. The coating compositions are characterized in that impression of impact printing forces against the window web and applied therethrough to the underlying coated sheet produces impact-pattern-correlated visual imprints on the envelope-housed sheet, the imprints being clearly viewable through the transparent web of the envelope window.

8 Claims, 1 Drawing Sheet

EXTERIORLY CONTROLLED ADDRESSING SYSTEM FOR WINDOW MAILERS

This is a continuation-in-part application of Giordano application Ser. No. 07/732,904 filed Jul. 19, 1991.

BACKGROUND OF THE INVENTION

The present invention relates to stuffed, sealed, multi-ply envelope assemblies or "mailers". More particularly, the invention is directed to mailers which use carbonless paper in a chemical imaging system and in which pressure or impact is relied upon to cause two different coatings on adjacent sheets of a multi-ply assembly to react chemically to generate visual indicia corresponding in configuration to the impact pattern, as a faithful copy thereof.

Multi-ply mailers of the general type indicated are well known in the art. Typically, a "top" sheet is coated on its back (CB sheet) with microscopic capsules of a dye, the dye being in a colorless form. A "bottom" sheet is coated on its front (CF sheet) with a chemical activator. The dye remains colorless until, through pressure or impact, the rupturable capsules are broken or fractured permitting the dye to interact chemically with the activator so that a colored form of the dye is generated, thus providing a desired visual image.

Intermediate plies of the multi-ply mailer assembly are coated front and back (CFB sheets) so that each bottom-coated sheet mates with a respective top-coated sheet therebeneath to generate visual images on the top surface of each of the racked sheets in the stacked multi-ply assembly or mailer.

In some prior art mailers the indicia-generating chemical components, including the pressure-rupturable dye capsules and the color-developing acceptor are contained in a single coating.

Formulations for and methods for producing coating compositions containing pressure-rupturable microcapsules of a colorless dyestuff precursor and coating compositions containing a color developer or dyestuff acceptor, or dye-activating or converting chemical agent are known in the art. Neither the formulations nor their methods of manufacture constitute elements of the present invention.

Processes for the production of coating compositions containing dye microcapsules and for applying the coating compositions to a paper substrate are described in Yoshida and Brabender U.S. Pat. No. 4,985,484 issued Jan. 15, 1991. The entire disclosure of that patent is hereby specifically incorporated herein by reference, to the extent it is not inconsistent herewith. The activator may consist of hot melt flakes of wax-like consistency and properties, with chemical additives. Application is made in the melted form.

Coating composition for producing image forming receptor coatings for reacting with the dye from the fractured microcapsules are also well known and are adequately described in issued patents including Chang U.S. Pat. B1 4,425,386 issued Mar. 29, 1988. The disclosure is hereby specifically incorporated herein by reference, to the extent it is not inconsistent herewith.

The activator compositions may be applied to paper substrates from a melted wax system using a hot melt coater which applies the melt to the press plate rolls of a printer machine. Coating of the press is also feasible.

Liquid coating systems containing encapsulated chromogenic dyes may be employed. These systems are either water based, or of a non-aqueous type.

Suitable compositions and the coating equipment employed to produce carbonless papers are described in technical literature readily available from The Mead Corporation of Dayton, Ohio, for example, their OPAS® (on/off Press Application System) liquid coating system, materials and equipment. In the light of the above and other extensive and readily available patents, published articles, and promotional literature, no further or detailed treatment of these areas is deemed necessary herein.

It is in the addressing of mailers of the type described above that the present invention finds special utility, particularly where the addressing is carried out automatically as with a computer-controlled machine involving a line printer. A widespread practice in the prior art is to deposit a CB coating on the back of the plies and a CF coating on the face, using the OPAS system described. In this arrangement, the top sheet or file copy is used primarily for selective transfer of the address to the outgoing envelope, and secondarily, as a file copy. Most companies have no need for a "file copy", since their computer stores the data on magnetic tape. It would, therefore, be desirable to eliminate this extraneous or unneeded sheet. The described simplification and elimination of the superfluous cover sheet are achieved in accordance with the practice of the present invention.

In one prior art method a system for image transfer which does not require a cover or top sheet relies upon a self-contained carbonless patch that is printed on the face of the outgoing envelope. Coating components react upon impact to create the "image". A disadvantage of this system is a tendency to produce smudging or objectional spurious markings resulting from unavoidable physical handling and postal processing of the mailer. In some cases the imprinted address indicia themselves tend to be obscured, rendered quite illegible, or even obliterated. Moreover, the self-contained coating material has an objectionally short shelf life.

Neubauer U.S. Pat. No. 4,729,506 entitled, "Mailer with Transparent Patch" describes a window envelope structure in which a transparent, window-closing patch is adhesively secured to a top panel of the mailer on an underside thereof.

The coating, cutting, bonding and collating steps which must be carried out to produce such a mailer are complex. The procedures are time-consuming and costly, calling for highly specialized equipment and for specially trained personnel to operate the equipment. The "patch" product does not lend itself to production utilizing the computer-controlled line ordinarily employed to fabricate mailers.

In marked contrast, the mailer of the present invention uses a physically separate and independent full web, panel or sheet contained within the window envelope assembly itself. Preferably, the entire areal expanse of this separate sheet is coated for impact imprinting, in selectable areas—a valuable option unavailable in the prior art. The transparent window sheet of the present invention is readily collated, as an additional sheet or web, with the other parts of the mailer. No special steps or equipment are required.

A principal aim of the present invention is to avoid the above-described short-comings and objectionable features of prior art mailers, particularly in the manner in which such mailers are addressed, and to provide improved structures and methods ensuring savings in material and resulting in enhanced and more reliable imprinted legends or indicia.

SUMMARY OF THE INVENTION

The present invention may be characterized as an improvement in business forms, or in multiple stuffed envelope business form assemblies or "mailers". Mailers of the general type involved include multi-ply sheets in which visual indicia such as address data, and other information, are generated through the use of specially-coated interacting carbonless papers arranged in a superimposed functional or operative sequence. The imaging is generated by interaction of different cooperating chemical agents contained in the coating compositions carried by adjacent respective sheets of stacked, overlying plies of the assemblies.

Impact pressure, preferably produced by a computer-controlled line printer, is relied upon to initiate the chemical interaction of coatings to provide visible print-outs or indicia. The indicia are correlated with and appear in the areas of pressure or impact.

The present invention is characterized in that the outer panel or top ply is provided with a die-cut opening, and in that a transparent closure or covering window web defines a see-through zone in the top ply of the assembly. In the arrangement described, the outer exposed face or surface of the assembly, and the window web itself are devoid of any coating of a type which contains a print-generating chemical agent. Printing or addressing of the envelope is effected interiorly of the assembly through impact induced chemical interaction between a coating composition on an under surface of the window web and a cooperating composition on a facing top surface of an abutting ply therebeneath. The indicia are thus generated interiorly of the assembly and are discernible and readily readable through the transparent window supported in the outer ply.

It is an important feature of the present invention that the outer surface of the outer ply or sheet of the mailer including the areal zone which shows the address, is devoid of inks, print-generating precursors or other marking or printing agents or compositions.

A related critical feature of the mailers of the invention is that the imprinted address indicia, while resulting from exteriorly applied and controlled pressure or printing-induced impact, are generated interiorly of the multi-ply assembly and are formed, preferably, on a top face of the ply immediately beneath the transparent window web.

An important advantage of the mailer of the assembly is that smudging, smearing or obliterative arbitrarily and unintending marking of the outer ply of the assembly are effectively eliminated.

Yet another feature of the invention is that the need for an extra or "throw-away" outer sheet, ordinarily used to effect an address imprint on the outer panel of the mailer itself, is obviated.

A related feature of the invention is that it makes possible savings in sheet stock, to reduce the overall cost of the mailers.

In a preferred embodiment of the present invention the underside of the window web carries a CB coating for interacting with a CF coating applied to a top surface of a ply immediately therebeneath, with the address or other image or visual indicia being formed on the ply beneath the window web, and visible therethrough.

It is a feature of the present invention that the mailers of the invention embody all the advantages and benefits associated with and derived from the use of "carbonless paper" as well as the operating economies which these types of papers enjoy.

A related feature of the invention is that the front-coated (CF) and back coated (CB) sheets are readily producible using established and known printing equipment and techniques, employing either water-based or non-aqueous systems, or even hot melt compositions. The operations can be carried out using auxiliary, on-press equipment on standard rotary forms presses. Alternatively, off-line coating equipment or separate stand-alone units can be used.

In one embodiment of the invention the coating materials used are non-waxy, low-viscosity, water-based emulsions having the consistency of water-based latex paint. Non-aqueous systems may also be employed. The materials are metered out onto transfer cylinders and ultimately transferred to the web to be coated. Drying may be effected using such techniques as heated rollers and recirculating air.

It is a feature of the present invention that selective spot-coating may be employed.

In preferred embodiments of the invention the transparent window-closing web is coated on its back (CB) with a composition containing dye capsules, and the ply therebeneath is coated on its front (CF) with an image-forming or color-developing receptor surface, and all sheets between are coated front and back (CFB).

It is a feature of the present invention that the stylus of a computer-controlled printer head may be contacted directly to the outer ply of a multi-ply business form or mailer, without pick up by the stylus of coating compositions which contain color developing or print-generating chemical agents.

An alternative and often preferred method is to interpose a shield such as a blank or non-print ribbon between the printer stylus and the sheet to be impacted thereby.

In the practice of the present invention it is contemplated that indicia producing interacting coating compositions may be applied in selected or localized areas only.

It is a feature of the present invention that it obviates the need to use a chemically reactive ribbon in the development of visual images on an underlying sheet, for example, the front of the mailer, to which the ribbon-carried chromogenic agent is transferred.

Other and further objects, features and advantages of the invention will be evident from the following detailed description considered in conjunction with the drawings.

DETAILED DESCRIPTION OF ILLUSTRATED EMBODIMENT

Figure 1:
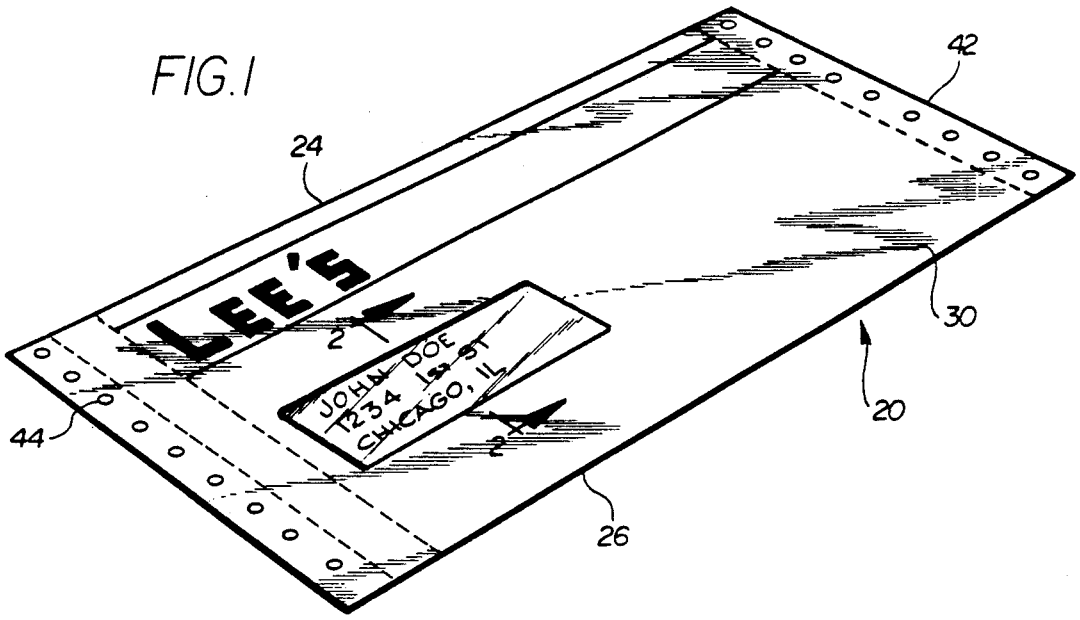
FIG. 1 is a perspective view of a single envelope of the mailer of the invention, showing the address imprinted, interiorly, beneath the transparent window.
Figure 2:
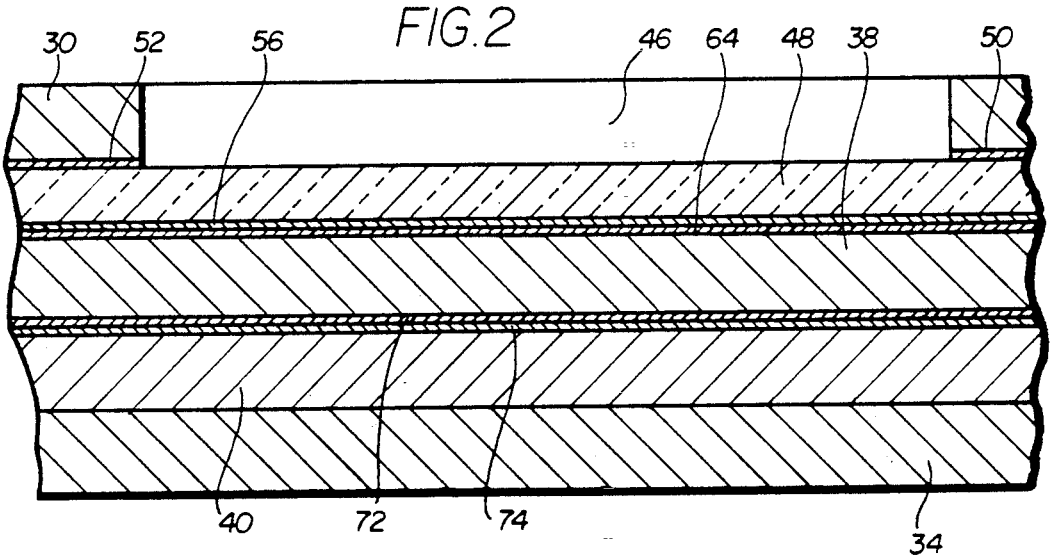
FIG. 2 is an enlarged cross-sectional view taken substantially on the lines 2—2 of FIG. 1 and indicating schematically various plies of the multi-sheet business form or mailer of the invention and the coatings disposed on front surfaces and back surfaces of the sheets of the composite.

The aims and objects of the present invention are achieved by providing, for use with computer printer techniques, a multi-ply business form assembly or mailer which includes, in cooperating combinations, a die-cut top sheet defining an envelope window, and a stacked array of auxiliary sheets disposed therebeneath. An underside of the window web and a top surface of the sheet immediately therebeneath are coated with compositions which contain chemical agents which react under pressure applied or upon impact to produce visible indicia or prints. The latter are correlated with and correspond to the pattern of the applied pressure. A permanent visual image is formed interiorly of the mailer, on the top surface of the top ply of the envelope insert and is visible through the transparent window. The structure, technique and apparatus described are particularly useful in the addressing of the mailers, using computer controlled printing devices.

Referring now more particularly to the drawings, for purposes of disclosure and not in any limiting sense, a preferred embodiment of the mailer of the invention is shown as an assembly 20. As shown in the drawings, the assembly 20 comprises a multi-panel or multi-ply window envelope. As produced, the envelope is a unit part of an edge-connected series of a continuous form. The structure includes other envelopes as a component of a lineal array and which are joined edgewise. The envelopes or mailers are susceptible to separation along transverse lines 24 and 26 delineating perforations. The latter facilitates zig-zag folding. The general structure and method of producing such business forms are well known and, accordingly, no details are provided or deemed necessary herein.

Each envelope 20 includes a top panel or sheet 30, a bottom panel 34, and an intermediate ply or panel 38. The assembly may include one or more additional panels 40, all panels being generally in vertical alignment or registry. At least the outer panels including the top panel 30 and the bottom panel 34 are joined to one another, marginally, by an adhesive or other suitable means to provide a "sealed" envelope. The unit envelope is formed with control margins 42 and line holes 44.

In accordance with the present invention the top panel 30 is die-cut to provide an opening or window 46, and a transparent or see-through web 48 secured to an underside 50 of the top panel 30 by an adhesive 52 overlies and bridges the cut-out zone 46 as a closure therefor.

It is an important feature of the invention that the transparent sheet or web 48 is coated on its underside or back (as a CB coating) with a "CB" composition 56 containing rupturable capsules of a chromogen or color-precursor chemical agent. The chromogen is capable of undergoing transformation into a visible dye or equivalent colored material upon interaction with a cooperating chemical agent or composition. To this end, the ply 38 immediately beneath the top panel 30 is coated on its top surface or front (as a CF coating), over an areal expanse which encompasses at least the window zone 46, with a composition 64 which contains an activator or color developer for interacting chemically with the chromogen contained in the (CB) coating composition 56 carried on the transparent web 48. The effect of interaction of the chromogen and the activator is to produce visible images or indicia 68, through a chemical interaction which is well known in the relevant art.

Figure 3:
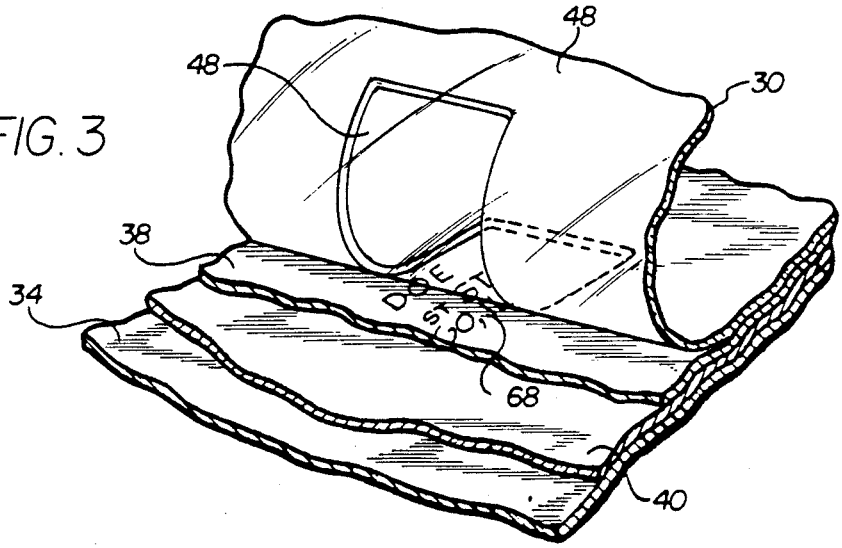
FIG. 3 is an enlarged, fragmentary perspective and schematic view of the mailer envelope of the invention with the die-punched top panel of the envelope turned back to show the clear transparent web overlying the cut-out window zone of the envelope.

In accordance with the practice of the present invention interaction between the chromogenic and the activator components in the respective CB coating 56 on the back or underside of the transparent web 48 and the CF coating 64 on the front or top side of the sheet or ply 38 beneath the web 48 is effected by applying controlled pressure derived from a printing-associated impact, using, for example, a computer-controlled printer. A permanent visual image 68 thus produced corresponds to the functional physical configuration of the impacting print head or plate. The image 68 itself is formed on and appears as an imprint on the top surface or front face of the uppermost insert ply 38 of the envelope assembly 20, as depicted schematically in FIG. 3. The indicia, for example, address particulars, thus generated are readily visible through the clear window-closing web 48.

It will be appreciated that the present invention constitutes a method and a product in which a mailer is addressed interiorly of the envelope or mailer. The imprint 68 is readily viewed through a protecting transparent window 48. No ink, carbon or carbonless print medium is present or exposed on the outside of the outer panel. Physical smudging and blurring of the image are obviated. The window web 48, which remains clean and unmarked, protects the image imprinted on the topmost of the inner sheets or plies 38. The need for single use, throw-away imprint sheets, whether carbon coated or another type, has been eliminated, together with the attendant expense.

It will be appreciated that when an additional interply sheet 40 is used, or a series of plies is used, each such sheet may also be imprinted, and in selectible islands or controlled areas. These areas are identified and defined by applied coating patterns and by controlling zones of mechanical impact. In the embodiment of the invention illustrated the first inner ply 38 is coated on its undersurface with a CB coating 72. A second ply 40 therebeneath is coated on its top surface with a cooperating and potentially interacting CF coating 74. Thus the top surface of the second ply or sheet 40 may be imprinted by mechanical impact forces applied thereto, as such forces may be derived from computer controlled printer heads impinging on the envelope assembly.

What is claimed is:

1. A form for a mailer, said form comprising a sealed window envelope assembly adapted for use with computer printing techniques in the addressing of envelopes, said assembly including an envelope having a top panel and a bottom panel, joinder means for connecting said top panel and said bottom panel to one another along coextensive, circumscribing perimetric marginal edge zones of said panels for forming a closed envelope, said top panel of said envelope being formed with a cut-out zone defining a window in said envelope, a light-pervious web beneath said top panel and providing a see-through closure for said window, a sheet disposed within said envelope for imprinting of information thereon, said sheet including an areal expanse in registration with and visible through said cut-out zone in said top panel of said envelope, said sheet bearing on a top surface thereof a first coating component of an interaction printing system for producing visual indicia on said sheet upon mechanically-impressed impact-contacting of said first coating component of said sheet against a co-operating, interacting second coating component, said light-pervious web bearing on an undersurface thereof a second coating component of the interaction printing system for reacting with (the sheet-carried) said first coating component in selectable areas (contacting thereagainst) including areas in addition to an area demarked by said cut-out zone, to produce selectable imprinted indicia on said sheet, imprinted indicia in registry with said cut-out zone being readily visible and clearly readable through said window, and any other indicia imprinted on said sheet being shielded from view by said top panel of said envelope, said web being distinct from said sheet and comprising an insert within said envelope, said web having an areal expanse coextensive with said envelope, said second coating component of the interaction printing system covering said areal expanse of said web for facilitating the generation of imprinted indicia on said sheet.

2. In a window envelope assembly adapted for use with computer printing techniques to provide a mailer, said assembly having a top panel and a bottom panel connected to one another at marginal edge zones to form an envelope, a cut-out zone formed in said top panel and defining a window in said envelope, light-pervious web means within said envelope for viewing through said window in an areal zone demarked by said window of said envelope, sheet means within said envelope for imprinting visible indicia thereon, a first coating composition deposited on said web means on an under surface thereof, a second coating composition deposited on said sheet means on a top surface thereof, said first coating composition and said second coating composition including components interacting upon mechanically-impressed impact-contacting of said web means against said sheet means to produce visual indicia on said sheet means in areas correlated with areas of impact contact to generate indicia visible through said window of said envelope, the improvement wherein said web means is of an expanse to embrace an entire area embraced by said envelope, and wherein said first coating composition constitutes a deposit on said web means for reaction with said second coating composition on said sheet means for producing visually-shielded indicia on said sheet means, said visually-shielded indicia being producible in areas other than an area delineated by said window of said envelope, said shielded indicia being screened from viewing through said window and being readable only upon opening said envelope.

3. The improvement as set forth in claim 2, wherein said web means comprises an insert within said envelope, said insert being free of attachment to said top panel of said envelope assembly in a region defining said window envelope.

4. The structure as set forth in claim 1, wherein said assembly constitutes a series of edge-connected, sealed envelopes delineated by and joined to one another along transverse lines of perforation adapted for severing mechanically to separate envelopes of said series from one another.

5. The structure as set forth in claim 1 wherein said second coating component covers the entire surface area of said web to obviate any need to apply an indicia producing coating composition on an undersurface of said top panel of said envelope.

6. A method for remotely imprinting indicia on an envelope-housed sheet, the imprinted indicia including indicia viewable through a transparent window of a window envelope having a window-forming cut-out zone, said method including the steps of providing within the envelope a light-pervious transparent web as an insert for the envelope, and coextensive with an areal expanse of the envelope, applying to the web on an under side thereof a first coating composition containing a first reactive coating component for interacting with a second reactive coating component in an imprinting step to form a visual image, applying to a top surface of a sheet distinct from said web and to be contained in the envelope, a second coating composition containing a second reactive coating component, positioning the coated sheet within the envelope with a coated top surface of the sheet presented to a coated underside of the web so that the interacting said sheet-carried and said web-carried coated surfaces face and are presented to one another, the coating compositions containing the respective first and the second reactive components being characterized in being responsive, under marking-device-generated contact impact stimuli impressed in overlying coextensive zones of the coated web and the underlying coated sheet, to form visible indicia on the sheet, the indicia thus formed being correlated with and corresponding to and defined by a configuration format generated by the impacting marking device, forcibly actuating a marking device to impact said web and said sheet in overlying zonal areas thereof with marking stylus means to establish selectible indicia constituting printed patterns on the sheet, the patterns including indicia visible through the transparent web of the window envelope, and indicia visible only upon opening the envelope.

7. The method as set forth in claim 6, wherein transparency of the web is maintained throughout the impact imprinting process to which the window envelope is subjected.

8. The method as set forth in claim 6, wherein the printed patterns on the sheet include patterns which are not visible through the window of the window envelope.

* * * * *